US009839279B2

(12) United States Patent
Seuk et al.

(10) Patent No.: US 9,839,279 B2
(45) Date of Patent: Dec. 12, 2017

(54) APPARATUS FOR CONNECTING A POUCH TO A SUPPORT ARTICLE

(71) Applicant: Patrol Incident Gear, LLC., Pacific, MO (US)

(72) Inventors: Jo Won Seuk, Highland Falls, NY (US); Tyler A. Cigard, Brooklyn, NY (US); Miguel Olivella, Cocoa, FL (US)

( * ) Notice: Subject to any disclaimer, the term of this patent is extended or adjusted under 35 U.S.C. 154(b) by 207 days.

(21) Appl. No.: 14/097,996

(22) Filed: Dec. 5, 2013

(65) Prior Publication Data

US 2015/0157117 A1 Jun. 11, 2015

(51) Int. Cl.

| | |
|---|---|
| ***A45F 3/06*** | (2006.01) |
| ***A45F 3/02*** | (2006.01) |
| ***A45F 3/04*** | (2006.01) |
| ***A45F 3/14*** | (2006.01) |
| *A45C 13/30* | (2006.01) |
| *A45F 3/00* | (2006.01) |

(52) U.S. Cl.

CPC ..... *A45F 3/02* (2013.01); *A45F 3/04* (2013.01); *A45F 3/06* (2013.01); *A45F 3/14* (2013.01); *A45C 2013/306* (2013.01); *A45F 2003/001* (2013.01)

(58) Field of Classification Search

CPC ..... A45F 3/06; A45F 3/04; A45F 3/02; A45F 3/14; Y10T 24/40; A45C 2013/306; A45C 2003/001

USPC ..... 224/182, 255–256, 578–579, 581–583, 224/603–605, 612, 614–615, 620, 623, 224/627, 637, 647, 649, 665, 671–672

See application file for complete search history.

(56) References Cited

U.S. PATENT DOCUMENTS

| | | | | |
|---|---|---|---|---|
| 5,579,966 | A * | 12/1996 | Krumweide et al. | 224/637 |
| 5,724,707 | A * | 3/1998 | Kirk et al. | 24/3.7 |
| 5,988,465 | A * | 11/1999 | Vitale et al. | 224/155 |
| 7,694,862 | B2 * | 4/2010 | Bergeron | 224/665 |
| 2008/0257929 | A1 * | 10/2008 | Cragg | 224/649 |
| 2011/0191933 | A1 * | 8/2011 | Gregory et al. | 2/69 |
| 2012/0168473 | A1 * | 7/2012 | Arajakis | 224/250 |

* cited by examiner

*Primary Examiner* — Scott McNurlen
(74) *Attorney, Agent, or Firm* — R. Tracy Crump

(57) ABSTRACT

Attachment apparatus for mounting a pouch to the straps of a support article, such as a chest rig, harness, backpack or the like. The attachment apparatus includes pair of locking tab and cord loops mounted to a pouch that couple together around the straps of a support article to secure the pouch to the support article. The locking tabs have a main section and a distal end that folds back over the main section and is bar tacked together so that the distal end lays back over the main section to form a "locking end." The locking tab extends through the tab loop and is interposed between the main section and the overlying distal end.

18 Claims, 8 Drawing Sheets

APPARATUS FOR CONNECTING A POUCH TO A SUPPORT ARTICLE

This invention relates apparatus used to attachment apparatus used to mount accessory pouches to worn support articles, and in particular attachment apparatus used to mount a pouch between the straps of worn support articles, such as chest rigs, back packs and the like.

BACKGROUND AND SUMMARY OF THE INVENTION

Detachable accessory pockets and pouches are common features for a variety of load bearing equipment, including, backpacks, chest rigs, utility belts and equipment harnesses. For example, military and law enforcement personnel generally carry additional ammunition magazines, radios, tools and other items in pouches or pockets detachably connected to duty belts, chest rigs, backpacks and load bearing harnesses. Similarly, hikers and backpackers also use packs with detachable pockets and pouches to provide additional carrying capacity. Support articles and load bearing equipment often use standardized mounting systems, such as the MOLLE attachment system, to provide a convenient means for attaching accessory pouches. While functional, most conventional attachment systems add considerable bulk and weight to gear in the form of arrays of webbing mounted to both the pouch and the support article as well as separate clips and fasteners that connect the pouch and support articles.

This invention provides a convenient attachment apparatus for connecting a pouch to the straps of a support article. The attachment apparatus includes a pair of locking tab and cord loops mounted to a pouch that couple together around the straps of a support article to secure the pouch to the support article. The locking tabs have a main section and a distal end that folds back over the main section and is bar tacked together so that the distal end lays back over the main section to form a "locking end." The locking tab extends through the tab loop and is interposed between the main section and the overlying distal end. In one embodiment, the attachment apparatus is incorporated into an accessory pouch and chest rig where the accessory pouch also includes a pair of buckle capture loops that enclose the chest rigs quick release buckles to prevent inadvertent release and a pair of opposed strips of hook and loop fasteners that help secure the bottom of the pouch to the chest rig.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
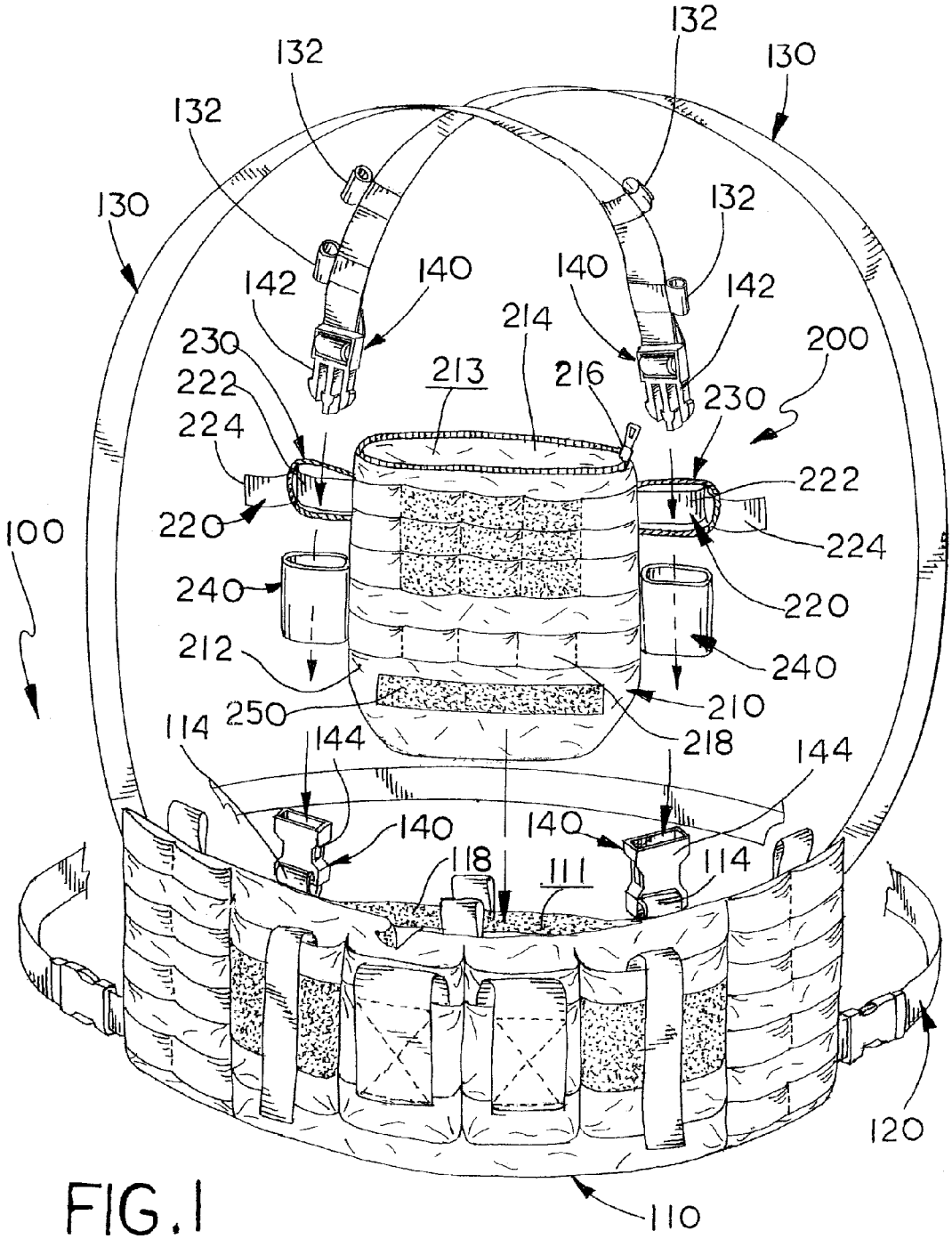
FIG. 1 is a perspective view of an exemplary accessory pouch and chest rig using the attachment apparatus of this invention shown in an unattached state.
Figure 2:
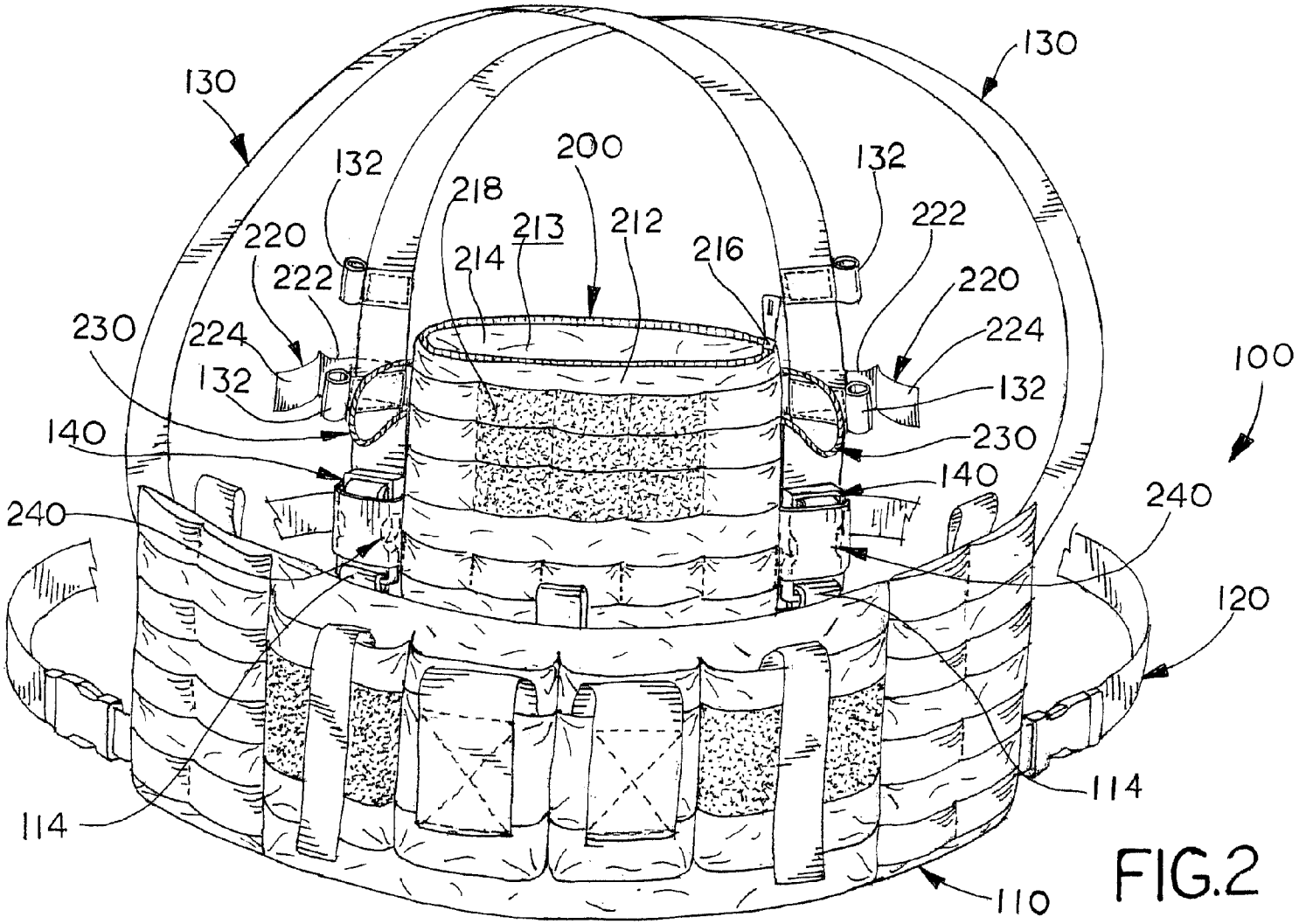
FIG. 2 is a perspective view of the exemplary accessory pouch and chest rig of FIG. 1 shown in a partially attached state.
Figure 3:
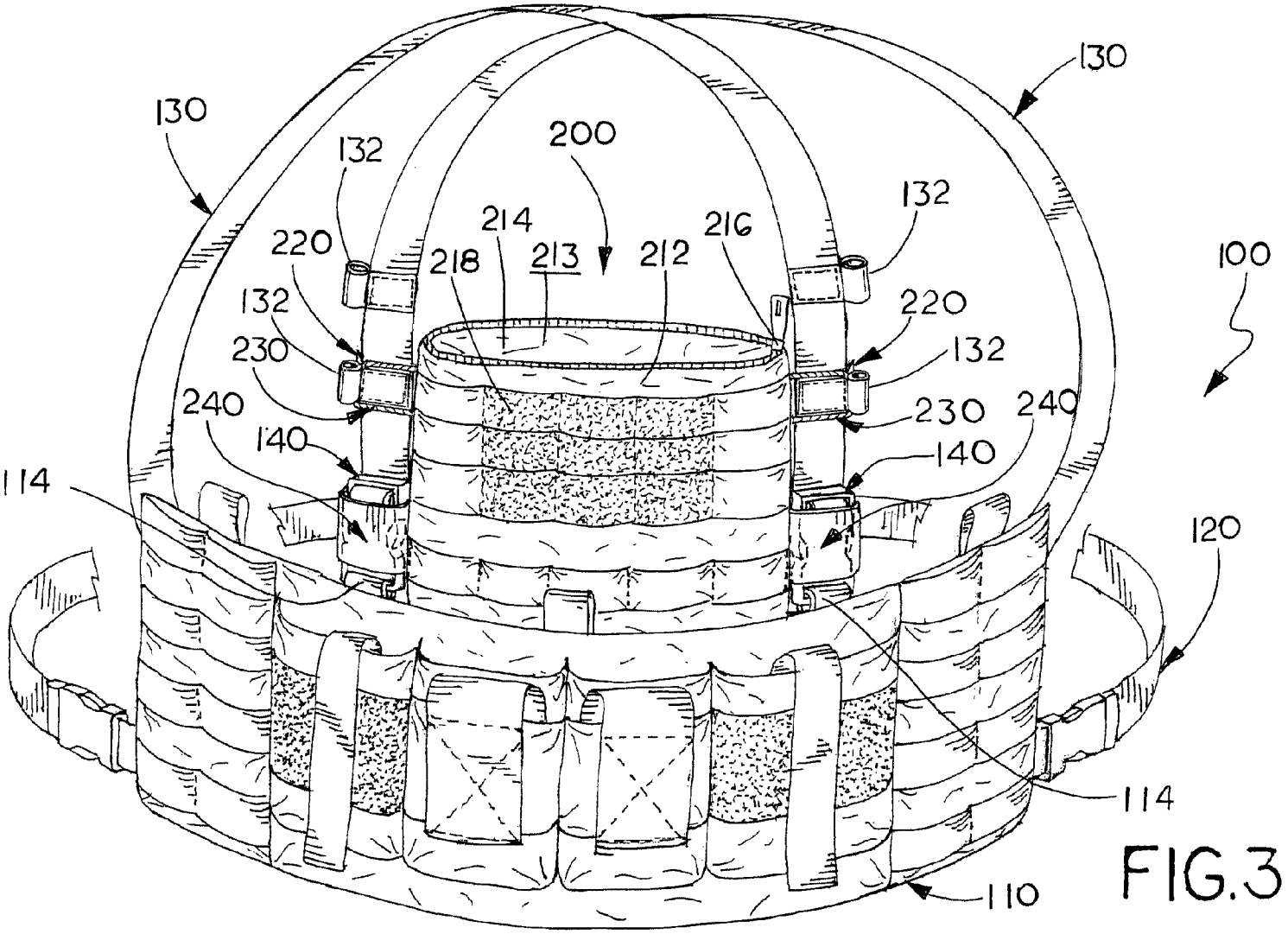
FIG. 3 is a perspective view of the exemplary accessory pouch and chest rig of FIG. 1 shown in an attached state.
Figure 4:
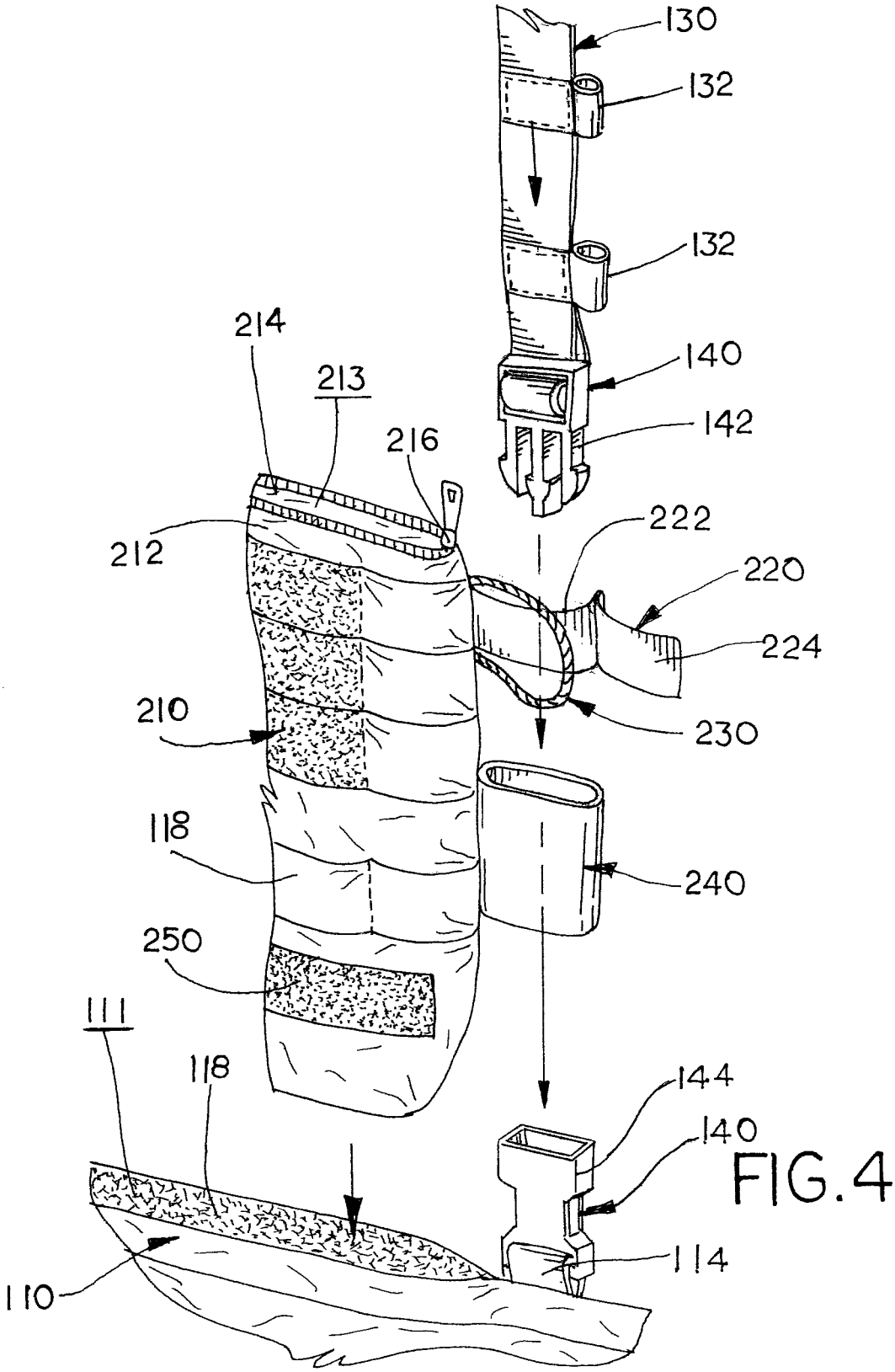
FIG. 4 is a partial perspective view of the exemplary accessory pouch and chest rig of FIG. 1 shown in an unattached state.
Figure 5:
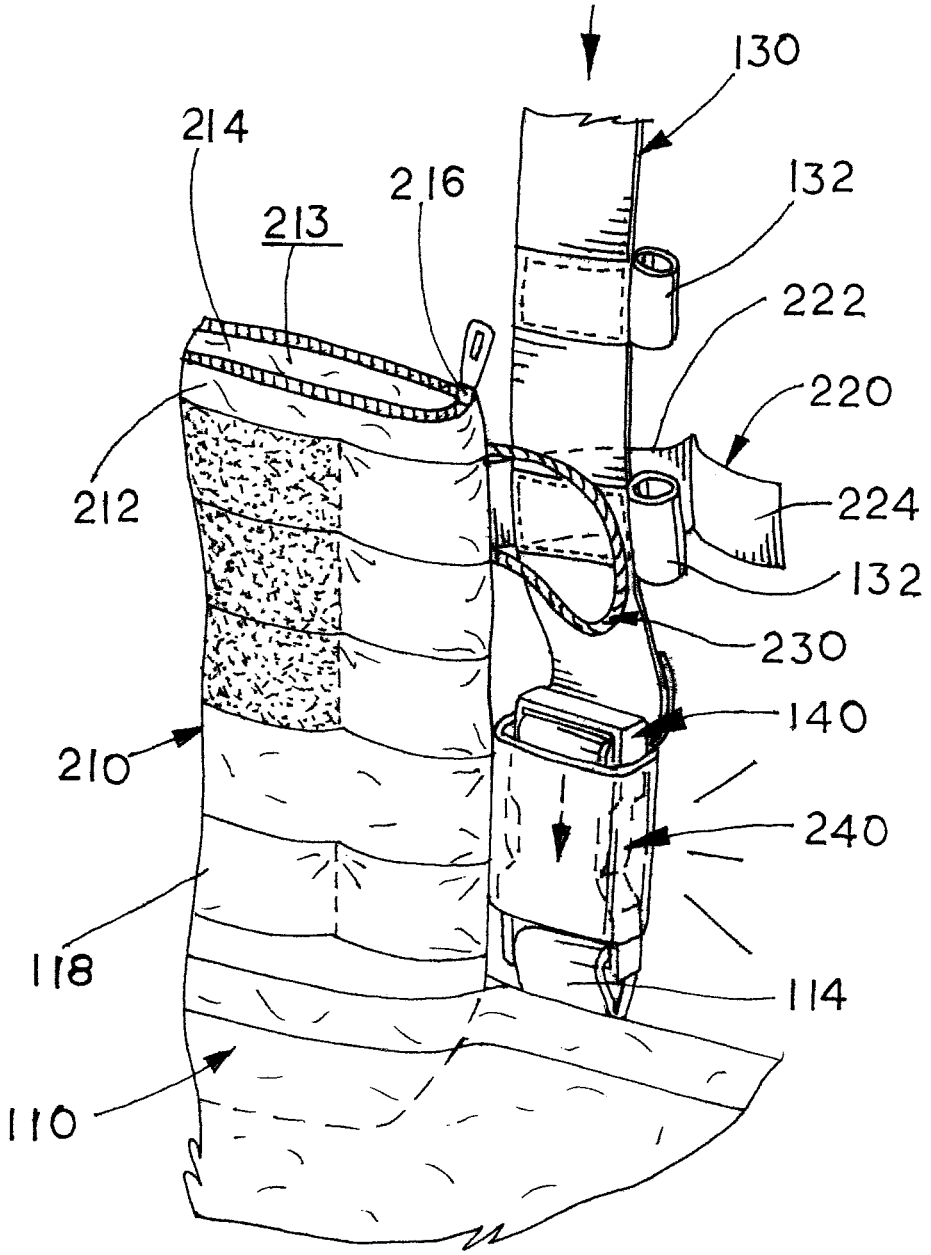
FIGS. 5 and 6 are partial perspective views of the exemplary accessory pouch and chest rig of FIG. 1 shown in a partially attached state.
Figure 6:
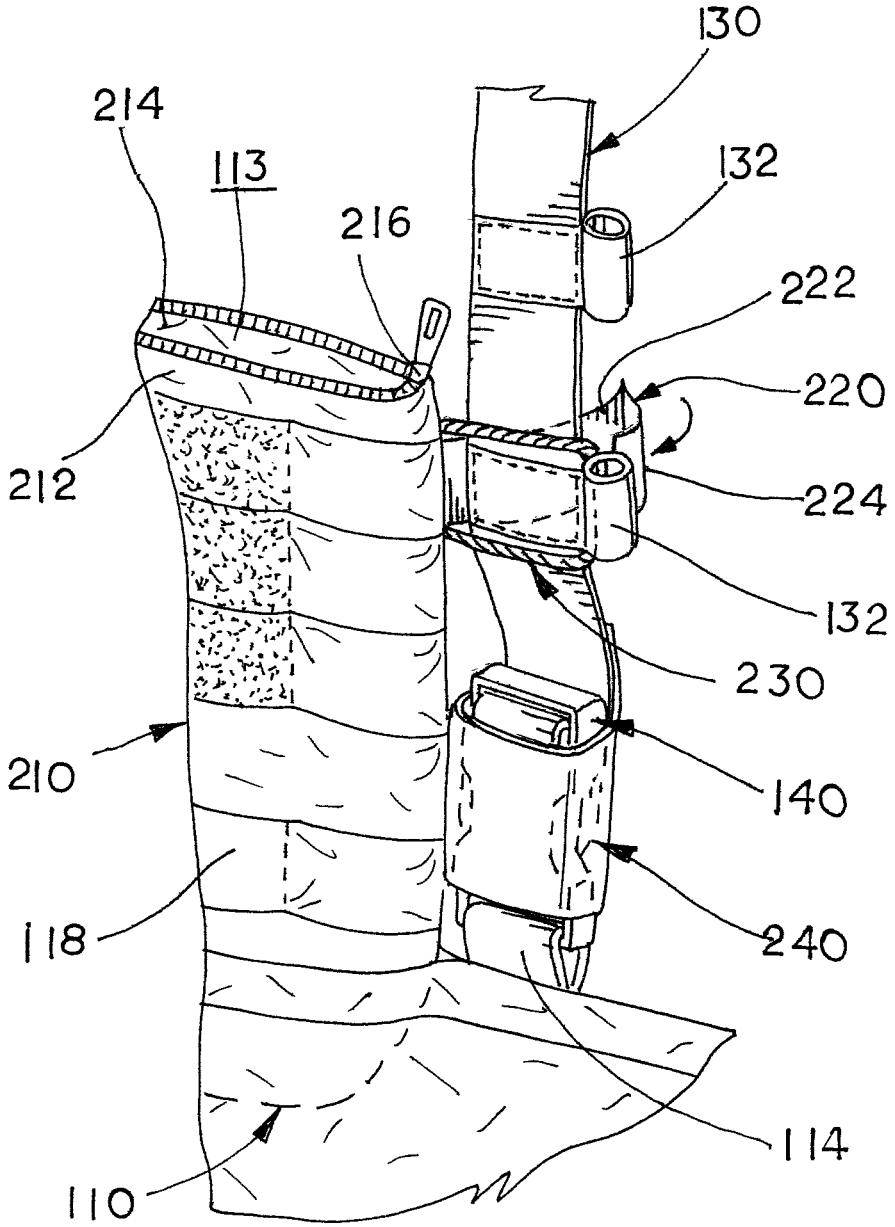
Figure 7:
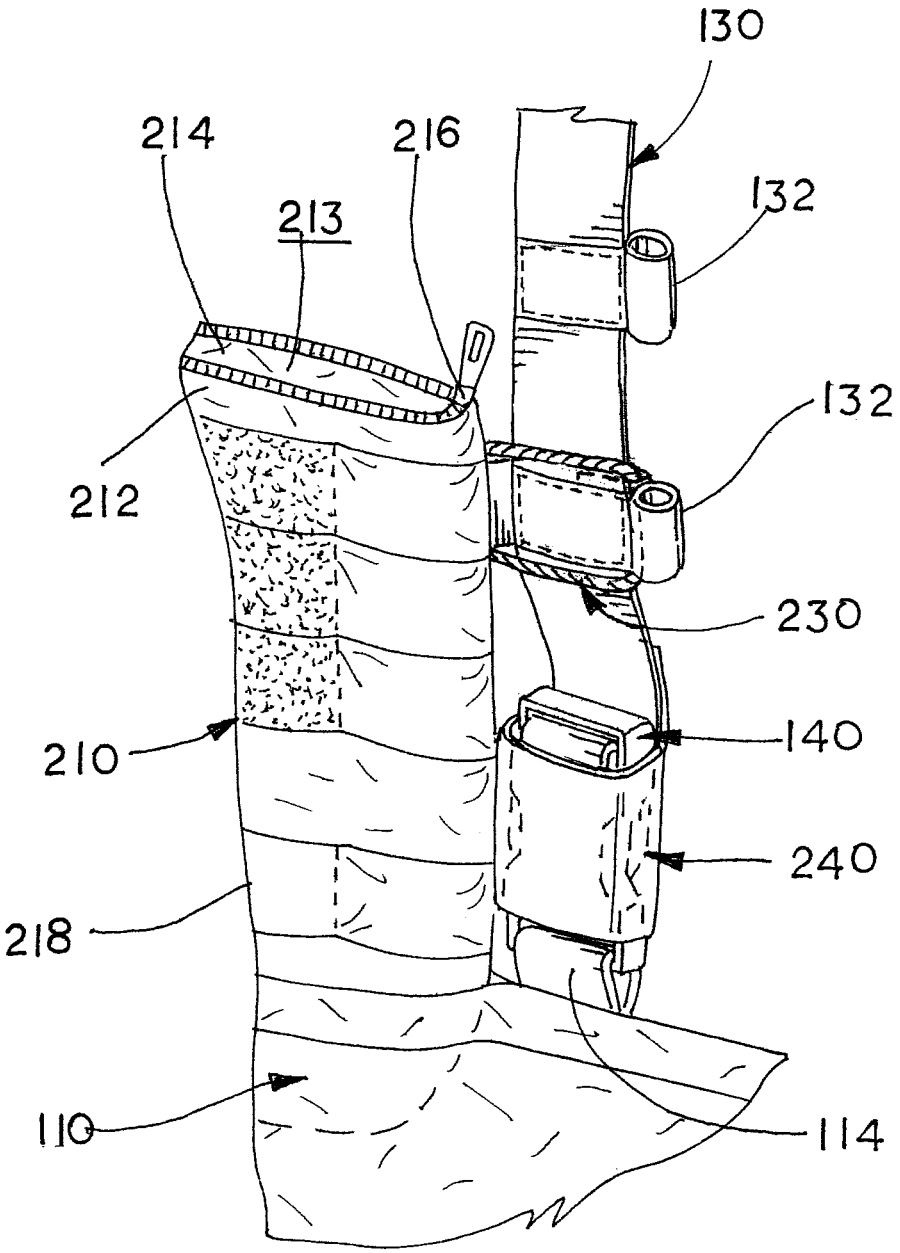
FIG. 7 is a partial perspective view of the exemplary accessory pouch and chest rig of FIG. 1 shown in an attached state.
Figure 8:
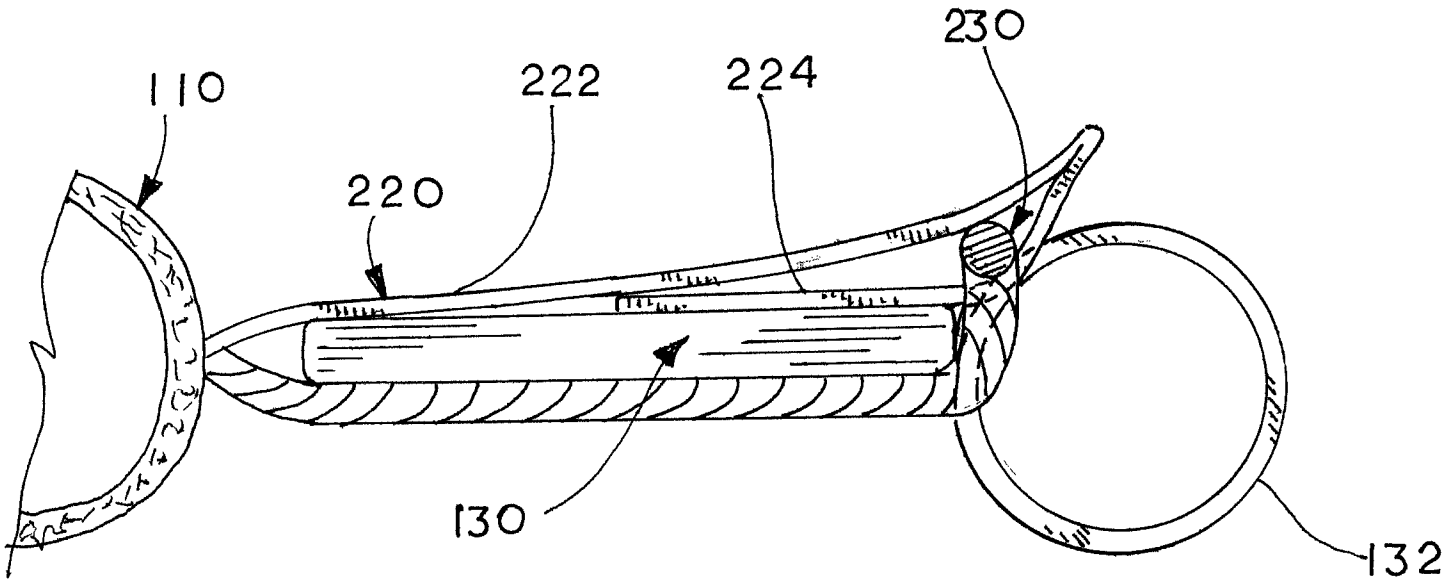
FIG. 8 is a top view of the exemplary accessory pouch and chest rig of FIG. 1 taken along line 8-8 of FIG. 7.

Referring now to the drawings, FIGS. 1-8 illustrate an exemplary chest rig 100 and a detachable accessory pouch 200 that incorporates an attachment apparatus of this invention for connecting a pouch to the straps on a support article. While illustrated in the drawings and explained herein, as part of a chest rig and detachable accessory pouch, the attachment apparatus of this invention may be adapted for use with other detachable accessory pouches and support articles within the teachings of this invention. For example, in other embodiments of this invention, the attachment apparatus may be used to mount an accessory pouch between the shoulder straps of a backpack.

As shown, chest rig 100 is of conventional design and construction. Chest rig 100 is typically constructed of a durable nylon or similar fabric and uses nylon webbing for straps. As shown, chest rig 100 is configured to have various integral and mounted accessory and ammunition pouches. Chest rig 100 includes a main front body 110, a detachable waist strap 120 and two detachable shoulder straps 130. Straps 120 and 130 allow chest rig 100 to be donned by a user so that the main body 110 of the chest rig to be worn over the user's mid riff so that the items in its various pouches are immediately accessible. Shoulder straps 130 are connected to main body 110 by quick release buckles 140. Male connector parts 142 of buckle 140 are fitted to the free ends of each shoulder strap 130 and female connectors parts 144 are affixed to tabs 114 sewn to the top of main body 110. Each shoulder strap 130 also includes a pair of routing guides 132 extending from their outer edges. Guides 132 are used to route hydration tubes and wires from communication devices carried in or on chest rig 100. Main body 110 of chest rig 10 also includes a "kangaroo pocket" 111 formed between its front and rear panels, which provides an open top storage compartment inside the main body for small thin items such as maps, notebooks and the like. Kangaroo pocket 111 is enclosed by strips of opposed hook and loop fasteners 118 sewn across the mouth of pocket 111.

Accessory pouch 200 is ideally constructed of a durable fabric, such as Cordura nylon. Pouch 200 has main pouch body 210 configured as a zipper topped pocket. Pouch body 210 is formed by front and back panels 212 and 214 hemmed and sewn together around it bottom edge and two side edges to form an open top mouth 213. A zipper 216 is sewn to panels 212 and 214 across mouth 213. Panels 212 and 214 are covered in PALs webbing 218 as desired to allow other accessory pouches and items to be conveniently mounted to pouch 200.

The attachment apparatus of this invention includes a pair of locking tabs 220 and tab loops 230 that wrap around shoulder straps 130. Locking tabs 220 are short lengths of nylon webbing extending laterally from the side edges of pouch body 110. Locking tab 220 is configured having a main section 222 and a distal end 224 that folds back over the main section and is bar tacked together so that the distal end lays back over the main section to form a "locking end." Tab loops 230 is a short length of braided cord or similar material, whose ends are connected to pouch body 110. The ends of tab loops 230 are sewn to the side edges of pouch body 110 with locking tab 220 interposed between the sewn ends of the tab loops. Locking tab 220 extends through tab loop 230 and is interposed between main section 222 and the overlying distal end 224.

Accessory pouch 200 also includes a pair of buckle capture loops 240 and a pair of opposed hook and loop strips 250 that help further secure the pouch to chest rig 100. Buckle capture loops 240 extends from the side edge of pouch body 210, and enclose quick release buckles 140 to help prevent inadvertent buckle release. Buckle capture loops 240 are short lengths of elastic webbing whose ends are overlapped and sewn into the hem of the pouch body 210. The front and back panels 212 and 214 each have a transverse strip 250 of either hook or loop fasteners (only one strip is shown in the drawings), which meshes with hook and loop fastener strips 118 on the inside the mouth of kangaroo pocket 111 to further secure pouch 200 to chest rig 100.

FIGS. 1-8 best illustrate how accessory pouch 200 is detachably connected to chest rig 100. As shown, shoulder strap 130 extends through buckle capture loop 240 and encloses quick release buckle 140 when coupled together. The bottom of accessory pouch 200 is partially seated within the open mouth of kangaroo pocket 111 of chest rig 100. The bottom of accessory pouch 200 is secured within kangaroo pocket 111 by the engagement of hook and loop strips 250 and 118, which prevents shiftable movement of the bottom of the accessory pouch relative to the chest rig. Tab loops 240 are laid over the front of shoulder strap 130 and wrapped around guide 118. Locking tabs 120 are laid over the back of shoulder strap 130. Distal end 224 of locking tab 220 is pulled through tab loop 230 and tucked back over main section 222 under shoulder strap 130. Distal end 224 is interposed between main section 222 of locking tab 220 and the back of the shoulder strap 130, thereby securely connecting the accessory pouch 100 between the shoulder straps. Because distal end 224 is tucked back under and interposed between the back of shoulder strap 130 and main section 222 of lock tab 220, the distal end is held in place and cannot be pulled free from tab loop 240.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. An attachment apparatus for detachably connecting an article to a strap, comprising:

a cord loop extending from the article and having two opposed ends affixed to the article;

a locking tab extending from the article between the two opposed ends of the loop, the locking tab includes a first tab section extending outward from the article and a second tab section affixed to the first tab section, the first tab section having a first end affixed to the article and a second end extending from the article, the second tab section having a first end and a second end affixed to and overlying the second end of the first tab section so that the first end extends back over the first tab section; and a strap part extending outward from the strap, the strap part is interposed between the cord loop and the locking tab adjacent the article when the apparatus connects the article to the strap, such that the cord loop traverses over the strap and extends around the strap part, and the first tab section and the second tab section overlap each other and traverses under the strap with the cord loop restrictively received between the first tab section and the second tab section.

2. A combination of a support article and a pouch detachably connected to the support article, the support article includes a main body and a pair of shoulder straps connected to the main body and spaced apart from one another, the pouch includes a pouch body, a pair of loop parts extending from opposite sides of the pouch body, each of the pair of loop parts is adapted to overlie the front of the shoulder straps and have two opposed ends affixed to the pouch body, the pouch also includes a pair of locking tabs each extending from opposite sides of the pouch between the two opposed ends of one of the pair of loop parts, each of the pair of locking tabs is adapted to underlie the straps of the support article and includes an elongated tab main section and a tab distal end thereof configured to fold back over the tab main section to retain one of the pair of loop parts between the tab main section and the distal end when the pouch is connected to the support article, the main body of the support article has an internal pocket therein, the pouch partially seated within the internal pocket and secured by hook and loop fasteners when the pouch is connected to the support article.

3. The combination of claim 2 wherein each of the pair of shoulder straps includes a guide part extending therefrom, each of the loop parts adapted to extend around the guide part of one of the pair of shoulder straps when the pouch is connected to the support article.

4. The combination of claim 2 wherein each of the pair of shoulder straps is detachably connected to the support article by a buckle, the pouch includes a pair of capture loops, each of the pair of capture loops covers the buckle of one of the pair of shoulder straps when the pouch is connected to the support article.

5. A combination of a chest rig and an accessory pouch detachably connected to the chest rig, the chest rig includes a main body and a pair of shoulder straps connected to the main body and spaced apart from one another, the accessory pouch includes a pouch body, a pair of loop parts extending from opposite sides of the pouch body, each of the pair of loop parts is adapted to overlie the front of the shoulder straps and have two opposed ends affixed to the pouch body, the pouch also includes a pair of locking tabs each extending from opposite sides of the pouch between the two opposed ends of one of the pair of loop parts, each of the pair of locking tabs is adapted to underlie one of the pair of shoulder straps of the chest rig and includes an elongated tab main section and a tab distal end thereof configured to fold back over the tab main section to retain one of the pair of loop parts between the tab main section and the distal end when the accessory pouch is connected to the chest rig, the main body of the chest rig has an internal pocket therein, the pouch partially seated within the internal pocket and secured by hook and loop fasteners when the accessory pouch is connected to the chest rig.

6. The combination of claim 5 wherein each of the pair of shoulder straps includes a guide part extending therefrom, each of the loop parts adapted to extend around the guide part of one of the pair of shoulder straps when the accessory pouch is connected to the chest rig.

7. The combination of claim 5 wherein each of the pair of shoulder straps is detachably connected to the chest rig by a buckle, the pouch includes a pair of capture loops, each of the pair of capture loops covers the buckle of one of the pair of shoulder straps when the accessory pouch is connected to the chest rig.

8. A combination of a support article and a pouch detachably connected to the support article, the support article includes a main body and a pair of shoulder straps connected to the main body and spaced apart from one another, the pouch includes a pouch body, a pair of loop parts extending from opposite sides of the pouch body, each of the pair of loop parts having two opposed ends affixed to the pouch and a central loop part there between, the central loop part of each of the pair of loop parts is adapted to traversely overlie one of the pair of shoulder straps, the pouch also includes a pair of locking tabs each extending from opposite sides of the pouch adjacent one of the pair of loop parts and between the two opposed ends of the one of the pair of loop parts, each of the pair of locking tabs is adapted to traversely underlie one of the pair of shoulder straps of the support article and includes an elongated tab main section and a tab distal end thereof configured to fold back over the tab main section to receive and restrictively retain the central loop part of the one of the pair of loop parts between the tab main section and the distal end when the pouch is connected to the support article, the main body of the support article has an internal pocket therein, the pouch is partially seated within the internal pocket and secured by hook and loop fasteners when the pouch is connected to the support article.

9. The combination of claim 8 wherein the tab distal end of each of the pair of locking tabs is interposed between the tab main section and the one of the shoulder straps of the support article when the pouch is connected to the support article.

10. The combination of claim 8 wherein each of the pair of shoulder straps includes a guide part extending therefrom, each of the loop parts adapted to extend around the guide part of one of the pair of shoulder straps when the pouch is connected to the support article.

11. The combination of claim 8 wherein each of the pair of shoulder straps is detachably connected to the support article by a buckle, the pouch includes a pair of capture loops, each of the pair of capture loops covers the buckle of one of the pair of shoulder straps when the pouch is connected to the support article.

12. A combination of a chest rig and a pouch detachably connected to the chest rig, the chest rig includes a main body and a pair of shoulder straps connected to the main body and spaced apart from one another, the pouch includes a pouch body, a pair of loop parts extending from opposite sides of the pouch body, each of the pair of loop parts having two opposed ends affixed to the pouch and a central loop part there between, the central loop part of each of the pair of loop parts is adapted to traversely overlie one of the pair of shoulder straps, the pouch also includes a pair of locking tabs each extending from opposite sides of the pouch adjacent one of the pair of loop parts and between the two opposed ends of the one of the pair of loop parts, each of the pair of locking tabs is adapted to traversely underlie one of the pair of shoulder straps of the chest rig and includes an elongated tab main section and a tab distal end thereof configured to fold back over the tab main section to receive and restrictively retain the central loop part of the one of the pair of loop parts between the tab main section and the distal end when the pouch is connected to the chest rig, the main body of the chest rig has an internal pocket therein, the pouch partially is seated within the internal pocket and secured by hook and loop fasteners when the pouch is connected to the chest rig.

13. The combination of claim 12 wherein the tab distal end of each of the pair of locking tabs is interposed between the tab main section and the one of the shoulder straps of the chest rig when the pouch is connected to the chest rig.

14. The combination of claim 12 wherein each of the pair of shoulder straps includes a guide part extending therefrom, each of the loop parts adapted to extend around the guide part of one of the pair of shoulder straps when the pouch is connected to the chest rig.

15. The combination of claim 12 wherein each of the pair of shoulder straps is detachably connected to the chest rig by a buckle, the pouch includes a pair of capture loops, each of the pair of capture loops covers the buckle of one of the pair of shoulder straps when the pouch is connected to the chest rig.

16. A combination of a chest rig and an accessory pouch detachably connected to the chest rig, the chest rig includes a main body and a pair of shoulder straps connected to the main body and spaced apart from one another, the accessory pouch includes a pouch body, a pair of loop parts extending from opposite sides of the pouch body, each of the pair of loop parts is adapted to overlie the front of the shoulder straps and have two opposed ends affixed to the pouch body, the pouch also includes a pair of locking tabs each extending from opposite sides of the pouch between the two opposed ends of one of the pair of loop parts, each of the pair of locking tabs is adapted to underlie the straps of the support article and includes an elongated tab main section and a tab distal end thereof configured to fold back over the tab main section to retain one of the pair of loop parts between the tab main section and the distal end when the accessory pouch is connected to the chest rig, each of the pair of shoulder straps is detachably connected to the chest rig by a buckle, the pouch includes a pair of capture loops, each of the pair of capture loops covers the buckle of one of the pair of shoulder straps when the accessory pouch is connected to the chest rig.

17. A combination of a support article and a pouch detachably connected to the support article, the support article includes a main body and a pair of shoulder straps connected to the main body and spaced apart from one another, the pouch includes a pouch body, a pair of loop parts extending from opposite sides of the pouch body, each of the pair of loop parts having two opposed ends affixed to the pouch and a central loop part there between, the central loop part of each of the pair of loop parts is adapted to traversely overlie one of the pair of shoulder straps, the pouch also includes a pair of locking tabs each extending from opposite sides of the pouch adjacent one of the pair of loop parts and between the two opposed ends of the one of the pair of loop parts, each of the pair of locking tabs is adapted to traversely underlie one of the pair of shoulder straps of the support article and includes an elongated tab main section and a tab distal end thereof configured to fold back over the tab main section to receive and restrictively retain the central loop part of the one of the pair of loop parts between the tab main section and the distal end when the pouch is connected to the support article, each of the pair of shoulder straps is detachably connected to the support article by a buckle, the pouch includes a pair of capture loops, each of the pair of capture loops covers the buckle of one of the pair of shoulder straps when the pouch is connected to the support article.

18. A combination of a chest rig and a pouch detachably connected to the chest rig, the chest rig includes a main body and a pair of shoulder straps connected to the main body and spaced apart from one another, the pouch includes a pouch body, a pair of loop parts extending from opposite sides of the pouch body, each of the pair of loop parts having two opposed ends affixed to the pouch and a central loop part there between, the central loop part of each of the pair of loop parts is adapted to traversely overlie one of the pair of shoulder straps, the pouch also includes a pair of locking tabs each extending from opposite sides of the pouch adjacent one of the pair of loop parts and between the two opposed ends of the one of the pair of loop parts, each of the pair of locking tabs is adapted to traversely underlie one of the pair of shoulder straps of the chest rig and includes an elongated tab main section and a tab distal end thereof configured to fold back over the tab main section to receive and restrictively retain the central loop part of the one of the pair of loop parts between the tab main section and the distal end when the pouch is connected to the chest rig, each of the pair of shoulder straps is detachably connected to the chest rig by a buckle, the pouch includes a pair of capture loops, each of the pair of capture loops covers the buckle of one of the pair of shoulder straps when the pouch is connected to the chest rig.

* * * * *